US005511729A

United States Patent [19]

Husain

[11] Patent Number: 5,511,729

[45] Date of Patent: Apr. 30, 1996

[54] WASTE COMMINUTOR AND CUTTER ELEMENTS THEREFOR

[75] Inventor: Paul Husain, Bensenville, Ill.

[73] Assignee: Yeomans Chicago Corporation, Melrose Park, Ill.

[21] Appl. No.: 290,210

[22] Filed: Aug. 15, 1994

[51] Int. Cl.[6] ..... B02C 18/06; B02C 18/16; B02C 18/40

[52] U.S. Cl. ..... 241/46.01; 241/166; 241/236; 241/295; 241/DIG. 38

[58] Field of Search ..... 241/236, 295, 241/DIG. 38, 291, 166, 167, 46.01

[56] References Cited

U.S. PATENT DOCUMENTS

| | | | |
|---|---|---|---|
| 544,294 | 8/1895 | Evans . | |
| 1,178,386 | 4/1916 | Edwards . | |
| 1,598,364 | 8/1926 | Cassell et al. . | |
| 1,985,125 | 5/1932 | Weirtz . | |
| 2,044,480 | 6/1936 | Lord . | |
| 2,120,697 | 6/1938 | Finnegan . | |
| 2,661,665 | 12/1953 | Knoll . | |
| 2,753,908 | 7/1956 | Anderson | 241/236 X |
| 2,903,193 | 9/1959 | Anderson | 241/166 X |
| 3,151,645 | 10/1964 | Hesse | 241/295 X |
| 3,314,617 | 4/1967 | Sargood . | |
| 4,046,324 | 9/1977 | Chambers | 241/46.06 |
| 4,085,482 | 4/1978 | Charron | 17/26 |
| 4,134,555 | 1/1979 | Rosselet | 241/46.08 X |
| 4,165,043 | 8/1979 | Higashi et al. | 241/236 |
| 4,560,112 | 12/1985 | Rouse et al. | 241/236 |
| 4,702,422 | 10/1987 | Chambers, Sr. et al. | 241/46.06 |
| 4,767,065 | 8/1988 | Wray | 241/247 X |
| 5,048,764 | 9/1991 | Flament | 241/36 |
| 5,141,168 | 8/1992 | Pepper | 241/236 |

*Primary Examiner*—John Husar
*Attorney, Agent, or Firm*—Lockwood, Alex, FitzGibbon & Cummings

[57] ABSTRACT

A waste comminutor includes two cutting assemblies which include alternating cutter and spacer elements. The two cutting assemblies are intermeshed together so that portions of the cutter elements of each cutting assembly overlap. Surface interruptions, in the form of depressions, recesses or the like are located in the overlapping portions of the cutter elements and define waste particle receiving pockets having a shearing surface against which waste particles may be further comminuted.

26 Claims, 3 Drawing Sheets

WASTE COMMINUTOR AND CUTTER ELEMENTS THEREFOR

BACKGROUND AND SUMMARY OF THE INVENTION

The present invention generally relates to waste comminutors and, more particularly to waste comminutors having cutter elements with additional surfaces for the shearing or cutting of waste particles.

Comminutors are mechanisms that are used to reduce the particle size of solid waste material. The reduction in size is typically accomplished by a shearing, crushing, shredding action or the like which is performed by one or more rotating elements of the comminutor. Comminutors are most often used in the field of wastewater treatment to reduce the size of solid waste particles entrained in wastewater influent streams. Smaller particle size promotes more efficient treatment of the wastewater. Comminutors are also used in applications to reduce particle size of solid waste which is not entrained in a liquid solution.

Early comminutors utilized a relatively large rotating component formed from a series of spaced-apart discs which form a rotating screen. The screen has a series of cutting teeth mounted on its exterior at different locations which project therefrom and which extend through corresponding slots formed in a cutter bar held by the support frame of the comminutor. An example of such a comminutor is shown and described in U.S. Pat. No. 2,336,069, issued December 1943 to applicant's predecessor in interest, Chicago Pump Company. The comminutor shown in this patent is know as a "flow-through" comminutor where waste material particles impinge upon the rotating screen and are moved into contact with the cutter bar by the teeth of the screen where small pieces of the waste particles are cut or sheared from the waste. These style of comminutors perform their intended function very well. However, because they utilize a single rotating screen, flow-through comminutors require a relatively large space in a waste stream channel.

Other comminutor designs are more compact and utilize a pair of spaced-apart parallel cooperating rotating shafts which support a series of cutting elements or discs. Such a dual shaft comminutor structure is disclosed U.S. Pat. No. 4,046,324, issued Sep. 6, 1977. This comminutor utilizes two shafts, each of which contains a cutting or shredding assembly formed by multiple cutter and spacer elements arranged axially on the shaft in alternating fashion so that on each shaft any cutter element is spaced apart from any axially adjacent cutter by an intervening spacer which defines a series of annular open spaces. Each open space between adjacent cutter elements on one shaft receives an opposing cutter element from the other shaft. Thus, the cutter elements are staggered to form pairs of interactive comminuting elements in which a cutter element and spacer element are coplanar.

In a dual shaft comminutor, waste particles are sheared or cut apart in two fashions. In one fashion, they may be caught in the pairs of interactive comminuting elements between the outer circumferential edges of the cutter elements and the spacers which oppose them on the other shaft. In the second fashion, waste particles may be caught between the opposing planar surfaces of the cutter elements of the shafts. The comminuting action occurs in this second instance between the leading edges of the cutter elements. The counter-rotation of the cutter elements by the shafts provides the needed drive for the crushing, shredding, shearing and cutting actions which the cutters perform. However, there has been no attempt to increase the efficiency in such comminutors thereof by increasing the total number of comminuting surfaces of the comminutor or by providing the comminutor with any pumping characteristics. Additionally, dual shaft comminutors of the prior art do not include any means for self-cleaning.

The present invention is therefore directed to a waste comminutor having improved cutter elements which increase the total number of comminuting surfaces of the comminutor. The present invention is also directed to a waste comminutor in which the cutter elements provide a pumping action to reduce head loss through the comminutor and provide a self-cleaning action to dislodge particles from the cutter elements during operation.

Accordingly, it is an object of the present invention to provide a waste comminutor having cutter elements with additional contact surfaces against which waste particles are comminuted, the additional contact surfaces augmenting the efficiency of the comminutor.

Another object of the present invention is to provide improved cutter elements for use in waste comminutors, wherein the cutter elements include disc body portions having opposed planar surfaces with interruptions thereon such as pockets, recesses or the like in a cutting zone in the area where opposing shaft-mounted cutter element opposed planar surfaces overlap during operation.

Yet another object of the present invention is to provide an improved waste comminutor having a pair of counter-rotating comminuting assemblies disposed within a comminution chamber of the comminution, each assembly including a plurality of cutter elements axially arranged along the rotating shaft and separated by intervening spacer elements, the cutter elements having a series of pockets formed in exterior opposed, planar surfaces of the cutter elements radially outwardly of the spacer elements in the area wherein the cutter elements of the comminuting assembly overlap, the pockets providing additional surfaces against which waste particles may be cut or sheared.

Still another object of the present invention is to provide cutter elements for a waste comminutor having a circular body and an opening which receives a drive shaft therethrough for mounting the cutter element in the comminutor, the cutter element body having a thickness extending between two opposing planar surfaces, the body further having a series of recesses within the opposed surfaces annularly disposed in the body portion, and separated by intervening vanes which are generally aligned with the drive shaft upon which they are mounted, the vanes imparting a centrifugal force to waste particles and the stream of waste entry entering the waste comminutor so as to provide a self-cleaning action to the teeth of the cutting elements of the comminutor during operation.

Yet a still further object of the present invention is to provide a dual-shaft comminutor having two parallel, counter-rotating cutter assemblies comprised of alternating cutter and spacer elements axially arranged upon the two shafts, wherein the cutter elements are provided with flow directing means in the form of impeller vanes in addition to the cutting teeth thereof, the impeller vanes assisting in pumping a waste stream into the comminutor and promoting a self-cleaning action within the cutter elements.

The present invention accomplishes these objectives by providing a comminutor having two cutting assemblies mounted on two parallel, spaced apart cooperating drive shafts. The cutting assemblies include a plurality of cutter elements and spacer elements axially arranged on each drive shaft such that the cutter elements are separated by intervening spacer elements. The cutting assemblies of the two shafts are interengaged with each other such that the cutting elements of one shaft directly oppose the spacer elements of the other shaft in the same general plane and vice-versa. The cutter elements have opposed generally planar surfaces and a preselected thickness extending between the opposed surfaces such that the cutter elements of the two shaft cutting assemblies overlap each other.

Surface interruptions are defined in the opposed surfaces of the cutter elements and are disposed within the cutting zone of the cutter elements. This cutting zone generally occupies the area in which overlap between opposing cutting assembly cutter elements occurs and generally radially outwardly of the adjoining spacer elements but within teeth formed in the cutter elements at their outer circumferential edges. The surface interruptions may take the form of depressions, pockets, recesses or the like. These pockets collect and hold, or trap, waste particles passing through the comminutor and provide a surface within the comminution chamber which is parallel to the spacer elements separating adjacent cutting elements. The pockets hold the particles in place in a position for additional shearing which occurs in the horizontal plane of the comminutor. These additional shearing surfaces increase the overall efficiency of the comminutor and further provide a means to comminute waste particles of the type which promote clogging of the cutter elements, such as fibrous materials.

The pockets formed in the cutter elements include a base surface or floor which defines the depth of the pockets. The floor surface intersects at least one sidewall of its pocket to form a perimeter portion of the pocket and present a surface angularly offset from the cutter element opposed planar surfaces against which the waste particles are sheared by an adjoining cutting element. The floor surfaces of the pockets may be planar or may be sloped to permit waste particles to easily enter into the pockets and, after shearing exit out of the pockets during operation of the comminutor. The pockets are formed within the cutter elements proximate to the cutting elements and cutting teeth.

The surface interruptions formed in the cutter element body may also take the form of waste stream flow enhancing and directing means, such as spiral recesses or grooves which spiral outwardly from a hub portion and terminate near the circumferential edges of the cutter elements. These spiral recesses are disposed annularly around the hub portion and are separated by intervening land portions which effectively define impeller vanes in the body portions of the cutter elements. These vanes include sidewalls which intersect with a base or floor portion of the recesses such that the sidewalls of the vanes also present additional shearing surfaces against which waste particles may be comminuted.

The impeller vanes and their corresponding recesses not only define additional waste particle contact surfaces, but also define flow-direction means which impart pumping action to the comminutor which consequently reduces the head loss typically associated with comminution. This pumping action imparts a centrifugal force upon the waste stream entering the comminutor, whether the waste stream is entrained in liquid or not, and serves to fling waste particles away from the recesses to promote a self-cleaning action to the cutter elements.

These and other features, objects and advantages of the present invention will become more apparent from a reading of the following detailed description.

BRIEF DESCRIPTION OF THE DRAWINGS

In the course of this description, reference will be made to the attached drawings wherein like reference numerals identify like parts and wherein.

DESCRIPTION OF THE PREFERRED EMBODIMENTS

A cutter element 10 constructed in accordance with the principles of the present invention is illustrated in FIGS. 1–4. The cutter element 10 is intended for use as part of a waste comminutor apparatus 100 illustrated in FIG. 9 which is used to comminute solid waste material. Solid waste material enters the comminutor apparatus 100 either in a solid stream or entrained in a wastewater stream, and it is reduced in particle size by either cutting, shredding, tearing, shearing or crushing. These general actions all act to reduce the size of waste particles entering the comminutor and, for purposes of convenience, shall be referred to generally in this detailed description as "cutting".

Figure 9:
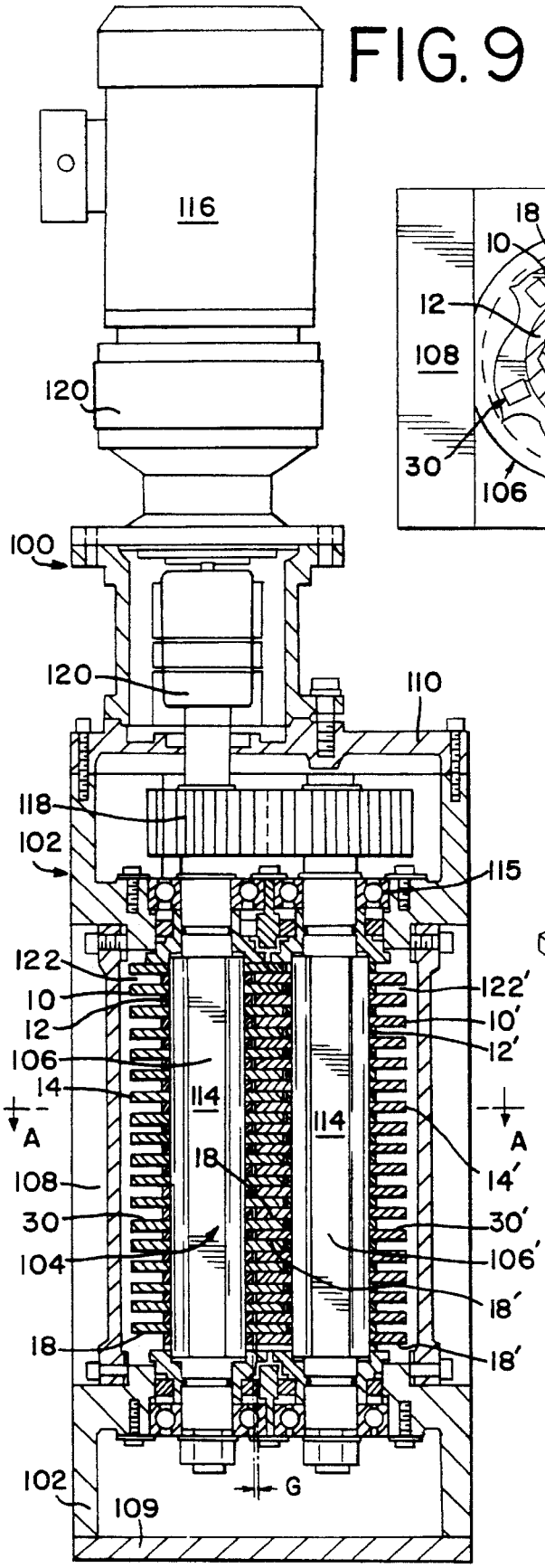
FIG. 9 is a sectional view of a comminutor apparatus incorporating the cutter elements of the present invention with the cutter element surface interruptions removed for clarity.

Turning to FIG. 9, the comminutor apparatus 100 includes pair of housings 102, which define a comminution chamber 104 in which two cutting assemblies 106, 106' are rotatably mounted. The housings 102 suitably include a pair of vertical sidewalls 108, a base member 109 and a cover member 110 which cooperate to enclose the cutting assemblies 106, 106' in the comminution chamber 104. The comminutor apparatus 100 includes an inlet opening 112 (FIG. 10), disposed between housings 102 through which the waste stream enters the comminution chamber 104. An outlet opening 113 (FIG. 10) is disposed generally opposite the inlet 112 between the housings 102 to provide an exit for the waste stream after comminution. The housings 102 and vertical sidewalls are adapted for installation into a waste stream channel, or connected to waste water pipes by suitable means (not shown).

The cutting assemblies 106, 106' include drive shafts 114, 114' rotatably mounted within the housings 102 and supported therein by conventional bearings 115. Throughout this detailed description, a reference numeral having a prime will refer to an element located on an opposing cutting assembly, i.e., the cutting assembly 106' shown on the right in FIG. 9. The cutting assemblies 106, 106' are driven in rotation by a suitable power source, such as an electric motor 116 which may be connected to the drive shafts 114, 114' by conventional gearing 118 and may preferably include a speed reducing arrangement 120.

Each comminutor cutting assembly 106, 106' includes distinct cutter elements 10, 10' and spacer elements 12, 12' arranged axially upon the respective drive shafts 114, 114' in spaced-apart order with the spacer elements 12, 12' alternating between adjacent cutter elements on each drive shaft. The cutter elements 10, 10' are generally larger than their associated spacer elements 12, 12' such that the cutter element diameter $D_c$ is greater than the spacer element diameter $D_s$. When the cutter elements 10, 10' and spacer elements 12, 12' are assembled onto the drive shafts 114, 114' to form the comminutor apparatus cutting assemblies 106, 106'. This diameter difference defines a series of annular interspaces 122, 122' between adjacent cutter elements on each shaft. (FIG. 9.)

Figure 10:
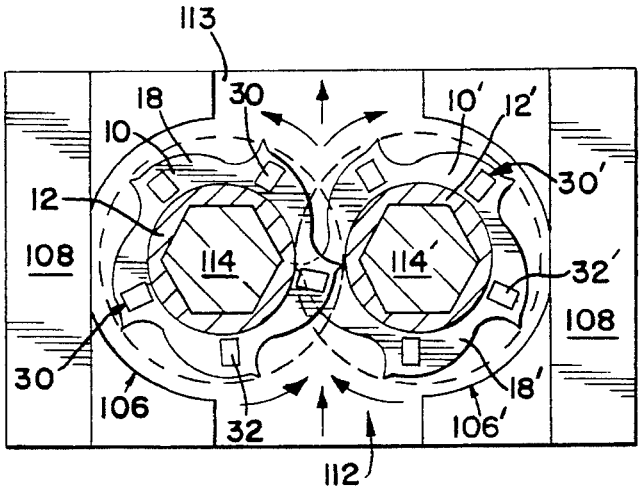
FIG. 10 is a plan sectional view of the comminutor assembly of FIG. 9 taken along lines A—A thereof.
Figure 11:
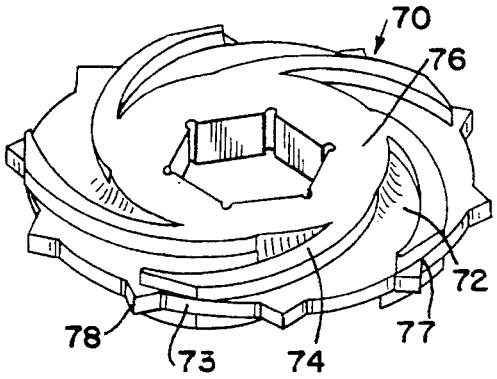
FIG. 11 is a perspective view of another, alternate embodiment of a cutter element of the present invention.
Figure 12:
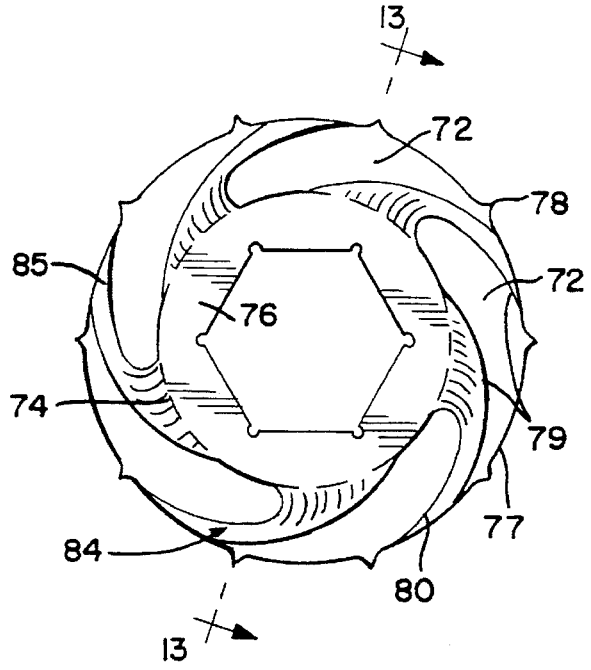
FIG. 12 is a plan view of the cutter element of FIG. 11.
Figure 13:
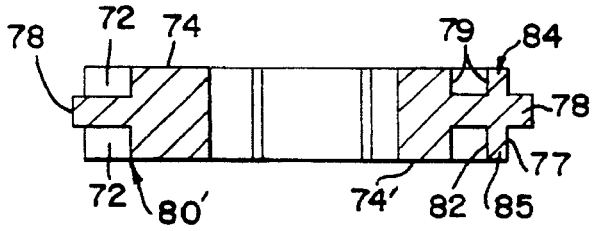
FIG. 13 is a sectional view of the cutter element of FIG. 12 taken along lines 13—13 thereof.
Figure 14:
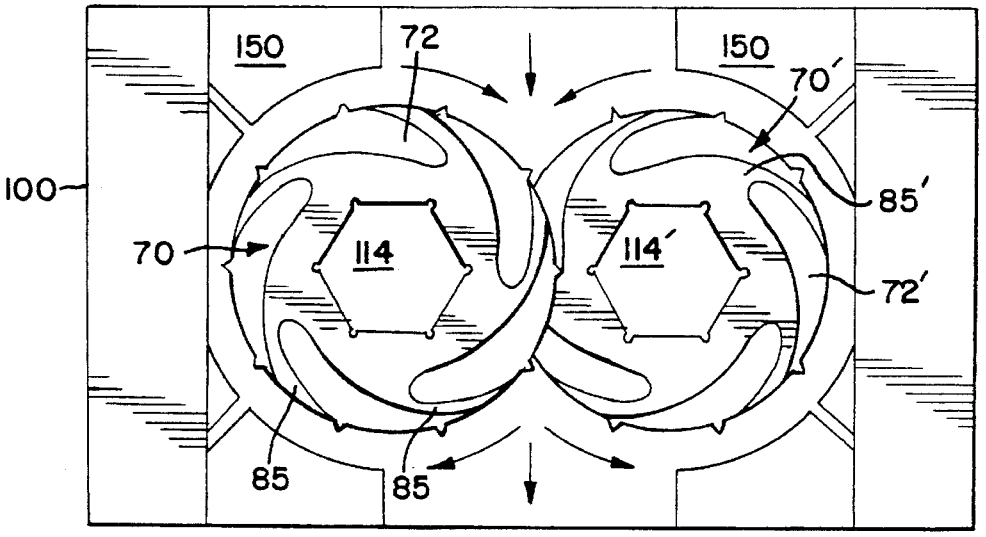
FIG. 14 is a plan sectional view of the cutter elements of FIG. 11 in place within a comminutor apparatus.

The cutter and spacer elements of the two cutting assemblies 106, 106' are staggered vertically when they are intermeshed together in the comminutor apparatus housing 102 such that the interspaces 122 formed on the first cutting assembly 106 (shown as the left drive shaft 114 in FIG. 9) receive the teeth 14' of the cutter elements 10' of the second cutting assembly 106' (shown as the right drive shaft 106' in FIG. 9) and the interspaces 122' formed on the second cutting assembly 106' receive the cutting teeth 14 of the first cutting assembly cutter elements 10. By virtue of this intermeshing, a number of pairs of cooperating or interactive comminuting elements are thereby formed in axial rows along the drive shafts 114, 114' of the comminutor apparatus 100 with each such pair including a cutter element 10, 10' and spacer element 12, 12'. (FIG. 10.)

As illustrated in FIG. 9, the drive shafts 114, 114' are preferably spaced parallel so that the teeth of the cutter element of the two cutting assemblies 106, 106' intermesh without binding during operation. The cutting assemblies 106, 106' may be spaced apart from each other such that the leading edges 16, 16' of the cutter element teeth 14, 14' are spaced a predetermined distance or gap G away from the outer circumferential or leading edges 17, 17' of the respective opposing spacer elements 12, 12'. This gap may vary in accordance with the performance desired from the comminutor apparatus 100. This gap G is one area of the comminutor apparatus 100 where comminution of solid waste particles occurs, primarily by crushing the particles between the opposing leading edges of the cutter and spacer elements.

The cutter elements 10, 10' generally have a predetermined thickness which is similar to that of the spacer elements 12, 12'. This thickness is defined between opposed planar surfaces 18, 18' of the cutter elements, which are oriented substantially horizontally (FIG. 9) when the comminutor apparatus 100 is positioned vertically within a waste stream channel. These opposed planar surfaces 18, 18' define another area where comminution occurs between the cutting assemblies 106, 106' which primarily includes shearing, shredding and cutting of waste particles when the waste is caught between the opposed planar surfaces 18, 18' of the cutting assembly cutter elements 10, 10' of the two cutting assemblies. This comminuting action may be best likened to a "scissoring" action wherein vertically adjacent cutter elements of opposing cutting assemblies act in the same manner as does a scissor blade in cutting an item.

The general structure of the comminutor apparatus 100 described above represents known construction and conventional knowledge of the prior art and similar structure is aptly described in U.S. Pat. No. 4,046,324 issued Sep. 1977, and generally forms no part of the present invention.

Returning to FIGS. 1–4, the cutter element 10 of the present invention is seen to have a body 20 which is preferably uniform throughout the extent of the cutter element 10. An opening 22 extends through the center of the cutter element body 20 and is adapted to receive a drive shaft 114 therethrough. This shaft opening 114 is illustrated in the Figures as a hexagonal opening, but may take any form such as square, rectangular, circular or the like, provided that it permits the drive shaft 114 to effectively drive the cutting assembly mounted thereon. The cutter element 10 further has a series of extending teeth 14 which extend radially outwardly from the cutter element body 20 and which define the leading edges 16 thereof. This outermost extent, is represented by the vertical edge 24 of the teeth 14 and thereby define the maximum diameter, $D_{max}$, of the cutter element 10.

Figure 8:
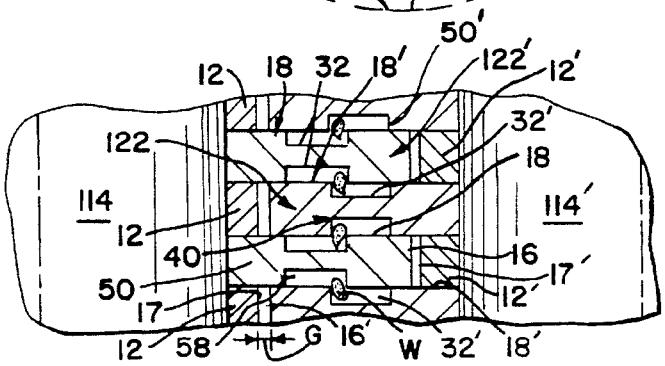
FIG. 8 is a schematic sectional view of the cutter elements of FIGS. 5–7 installed in placed within a comminutor.

The teeth 14 of the cutter element 10 shown in FIGS. 1–4 are illustrated as curvilinear in profile and extend radially and tangentially from a root diameter $D_{root}$ of the cutter element body 20. The cutter element body 20 also includes a hub portion 26 in the area of the body 20 which lies adjacent to the adjoining spacer elements 12, 12'. This hub portion 26 (as well as the leading edge 17 of the adjoining spacers 12 (FIG. 8)), defines a minor diameter $D_{min}$ of the cutter element 10. These major and minor diameters generally define a "cutting zone" 28 positioned on the opposed surfaces 18, 18' of the cutter elements 10, 10' (FIG. 9). This cutting zone 28 generally includes the area where staggered rows of cutter elements 10, 10' of the two cutting assemblies 106, 106' overlap.

Figure 1:
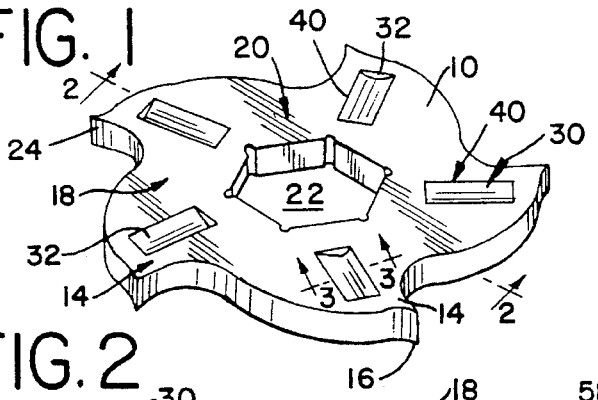
FIG. 1 is a perspective view of a comminutor cutter element constructed in accordance with the present invention.
Figure 3:
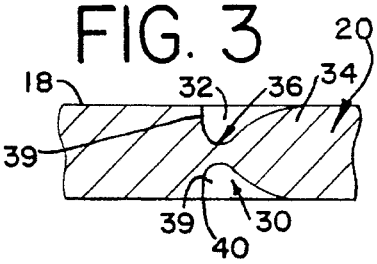
FIG. 3 is an enlarged partial sectional view of the cutter element of FIG. 1 taken along lines 3—3 thereof illustrating the profile of the surface interruption of the cutter element.
Figure 2:
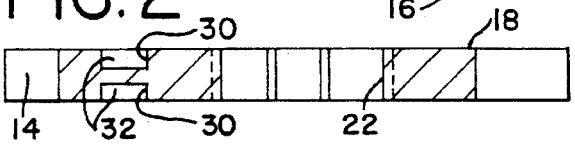
FIG. 2 is a sectional view of the cutter element of FIG. 1, taken along lines 2—2 thereof.
Figure 4:
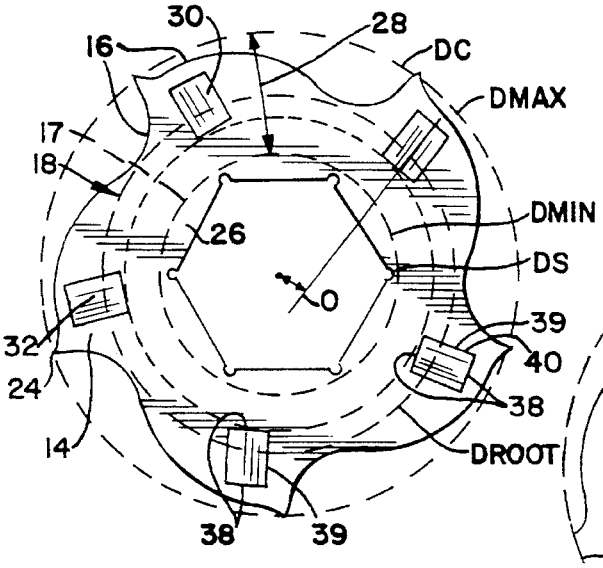
FIG. 4 is a plan view of the cutter element of FIG. 1.

In an important aspect of the present invention, surface interruptions 30, 30' (FIG. 1–4 & 10) are provided on the opposed surfaces 18, 18' of the cutter elements 10, 10' within the cutting zone 28 thereon, and preferably within the portion wherein adjacent cutter elements overlap during operation. As seen in FIG. 4, the surface interruptions 30 extend within the cutting zone 28 and substantially past the root diameter of the cutter element 10.

The surface interruptions 30 take the form of a depression 32 having a rectangular profile when viewed in plan, such as illustrated in FIG. 4. The depression 32 has a variable cross-sectional profile as depicted in FIG. 3, and includes a sloped ramp portion 34 that extends downwardly into the cutter element body 20 from the cutter element opposed surfaces 18, 18'. The ramp portion 34 terminates at a floor portion 36 of the depression 32 which intersects with two sidewalls 38 and an endwall 39 (FIG. 3–4) that cooperate with the floor 36 to define the overall depressions 32, 32'. The sidewalls 38 and endwall 39 preferably extend approximately 90° to the cutter element opposed surfaces 18, 18'. The angular orientation of the sidewalls 38 and endwalls 39 of the depressions 32 may vary from the preferred 90° so long as a distinct edge 40 is formed at the perimeter of the depression 32, where the sidewalls and endwall intersect.

In another important aspect of the present invention, the depressions 32 define additional comminuting surfaces in the cutter elements 10, 10' within the bodies 20, 20' thereof. Waste particles W which enter the comminutor apparatus 100 may be initially shredded by the scissoring action between the leading edges 16, 16' of the cutter elements 10, 10' or crushed between the leading edges of pairs of opposed cutter and spacer elements as discussed above. The waste particles W, and particularly troublesome waste particles such as fibrous materials, may be further comminuted when they are caught in the depressions 32 and held temporarily therein by the flow of the incoming waste stream until an adjacent cutter element 10' of the opposing cutting assembly 106' asses through the cutting zone 28 of the first cutting assembly 106. The waste particles accumulated in the depressions are forced against the edges 40 thereof by the adjacent-cutter element 10' of the opposing cutting assembly 106' and are further sheared apart. The depressions may be included on both of the cutter element opposed surfaces 18, or they may be included on only one such surface.

Figure 5:
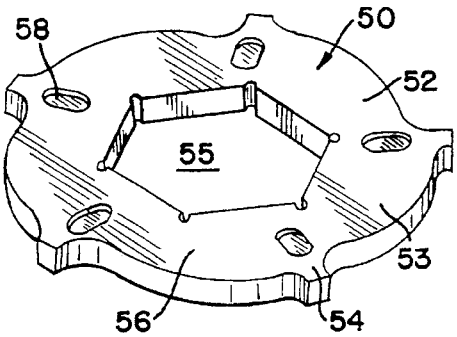
FIG. 5 is a perspective view of an alternate embodiment of a comminutor cutter element constructed in accordance with the present invention.
Figure 6:
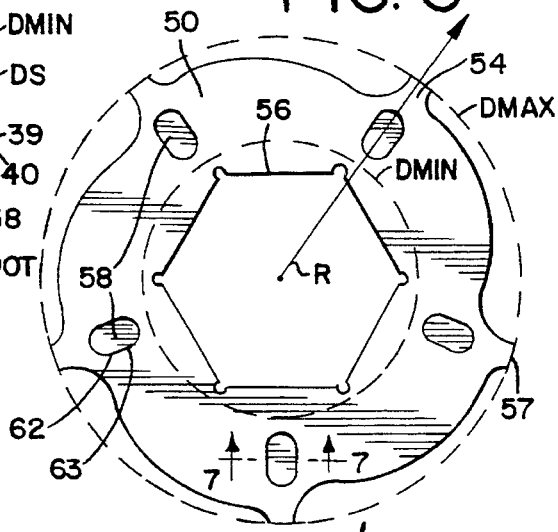
FIG. 6 is a plan view of the cutter element of FIG. 5.
Figure 7:
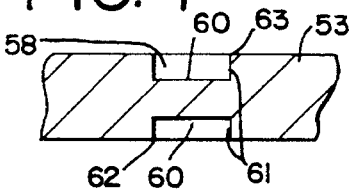
FIG. 7 is an enlarged partial sectional view of the cutter element of FIG. 6 taken along line 7—7 thereof.

FIGS. 5–7 depict a second embodiment of a comminutor cutter element 50 constructed in accordance with the principles of the present invention. Similar to the embodiment of FIGS. 1–4, the cutter element 50 includes a circular disc body 52 with a pair of opposed planar surfaces 53 defining the thickness of the cutter element 50. A plurality of cutting teeth 54 project radially outwardly from the body 52. A hub portion 56 which lies adjacent the adjoining spacer elements (not shown) when the cutter element 50 is assembled onto a drive shaft through its central opening 55 establishes the minimum diameter $D_{min}$ of the cutter element 50, while the outermost edges 57 of the cutter element cutting teeth 54 establish the cutter element maximum diameter $D_{max}$.

The surface interruptions of the cutter element 50 take the form of recesses 58 which have an oval-like configuration when viewed in plan, as shown in FIG. 6. The recesses 58 include a base or floor portion 60 which is surrounded by a vertical sidewall 61, which extends generally normally to the cutter element body opposed surfaces 53, 53' and intersect therewith to form a waste particle shearing edges 62. As mentioned previously and as illustrated in FIG. 8 (which is an enlarged sectional view of a pair of cutting assemblies 106, 106' utilizing cutter elements 50, 50' of the design of FIGS. 5–7), the waste particles W are driven into the recesses 58 of the cutter elements 50 of one cutting assembly 106 by the flow of the incoming waste stream and remain temporarily therein, until the opposing cutting assembly cutter elements 50' force them against the shearing edges 62 of the recesses 58 and vice-versa.

The recesses 58, 58' of the cutter element 50 are located as generally aligned radially with a radial centerline R of the cutter element cutting teeth 54. The surface interruptions need not be radially aligned with either the cutter element itself or the cutting element cutting teeth in every instance. As shown in the cutter element of FIG. 4, the depressions 32 are slightly offset from the center of the cutter element 10 by a distance 0 and are not aligned with the centerlines of the cutting teeth 14, but rather are somewhat removed from the circumferential front surfaces of the cutting teeth 14.

A third embodiment of a cutter element 70 constructed in accordance with the present invention is illustrated in FIGS. 11–14 where the surface interruptions include a series of spiral grooves 72 formed in the body 73 thereof. These grooves 72 are disposed in the opposed body surfaces 74, of the cutter elements 70 and extend out from the cutter element hub portion 76 to the circumferential edges 77 of the cutter element body 73, terminating just short of the cutting teeth 78 which continue to project outwardly. These grooves 72 are bounded by sidewalls 79 that form the additional shearing or cutting edges 80 on the cutter element surfaces 74.

The grooves 72 are spaced annularly around the cutter element hub portion 76 and are spaced apart from each other by intervening land portions 84 which form a series of impeller vanes 85 in the cutter element opposed body surfaces 74. These vanes 85 provide a waste stream flow-directing means feature to the waste comminutor 100 in that they act in a manner similar to impeller vanes used in a centrifugal pump to impart a centrifugal force to incoming waste stream to thereby effect a pumping action which is believed to result in a reduction of head loss through the comminutor by directing the flow into and out of the comminutor 100. In this regard, the comminutor housings 102, 102' may preferably include solid sidewall portions 150 which present a partial reaction surface to the vanes. In addition, the cutter elements 70 will have a tendency to fling waste particles which may tend to lodge in the grooves 72, thereby promoting a self-cleaning effect of the cutter elements 70 during operation.

The surface interruptions may be formed in the opposed surfaces of the cutter elements in a variety of ways. They may be stamped into the cutter element body in instances where the interruption includes a depression of constant cross-section such as shown in FIGS. 5–7. The interruptions may be machined in instances where a recess of variable cross-section is formed in the cutter element body such as shown in FIGS. 1–4 or they may be formed by a suitable process such as electrical discharge machining (EDM) when a complex interruption, such as the spiral grooves of FIGS. 11–14 is desired.

It will be appreciated that the embodiments of the present invention discussed herein are merely illustrative of a few applications of the principles of the invention. Numerous modifications may be made by those skilled in the art without departing from the true spirit and scope of the invention.

I claim:

1. A comminutor for reducing the size of waste particles entrained within a stream of waste, comprising:

a housing defining a comminution chamber, the housing having an inlet which leads into the comminution chamber and an outlet which leads out of said comminution chamber;

a comminution assembly disposed within said chamber including two rotatable stacks of cutting assemblies disposed in said comminution chamber, each of said cutting assemblies including a plurality of cutter elements axially arranged thereon and separated from each other by a plurality of intervening spacer elements, said cutter elements and spacer elements having different diameters such that said spacer elements define interspaces between adjacent cutter elements of each of said cutting assemblies, said two cutting assemblies being further intermeshed with each other in a manner whereby a cutter element of one cutting assembly generally opposes and lies substantially coplanar with a spacer element of the other of said two cutting assemblies and wherein a portion of said cutter element projects into a coplanar interspace of an opposing cutting assembly, said cutter elements each having a body portion of predetermined thickness bounded by opposed surfaces, the cutter element body portion including a hub portion which bears against adjoining spacer elements, said cutter elements further including cutting teeth extending outwardly from said cutter element body portion, each of said cutter elements further having a cutting zone defined thereon between said cutting teeth and hub portions thereof, said cutter elements further including surface interruption means disposed in said body portion cutting zone which define a plurality of individual waste particle-receiving pockets spaced apart from each other in a preselected pattern on at least one of said opposed planar surfaces of said cutter element body portions and disposed within said cutting zone, whereby each said individual pocket is associated with an individual cutting tooth, said pockets further defining isolated contact surfaces in said cutter element body portion opposed surfaces against which waste particles may be held and further comminuted.

2. The comminutor of claim 1, wherein each of said pockets includes a recess having a depth which varies along a cross-section of said pocket.

3. The comminutor of claim 1, wherein said pockets include depression having a substantially constant depth, said depression being surrounded by vertical sidewalls.

4. The comminutor of claim 1, wherein said pockets include a ramped floor portion and at least one intersecting sidewall which intersects with said floor portion to promote the flow of waste particles through said pockets.

5. The comminutor of claim 1, wherein said pockets include spiral grooves formed in said cutter element body portions which promote cleaning of said pockets during operation of said comminutor.

6. The comminutor of claim 5, wherein said spiral grooves are annularly spaced around said cutter element hub portions and separated by intervening land portions which define impeller vanes in said cutter element opposed surfaces.

7. The comminutor of claim 6, wherein said impeller vanes terminate radially inwardly of said cutting teeth.

8. The comminutor of claim 1, wherein said cutting teeth project radially outwardly from said body portion along a root diameter thereof and said pockets are disposed in said preselected pattern in said cutter element cutting zone such that they intersect with said cutter element root diameter.

9. The comminutor of claim 1, wherein said waste particle-receiving pockets are radially aligned within said cutting teeth.

10. The comminutor of claim 1, where said individual waste-receiving pockets are disposed on both of said opposed planar surfaces of said cutter elements.

11. A cutter element for use in a waste comminutor cutting assembly having a plurality of cutter elements axially arranged on an elongated shaft in spaced-apart relationship, the cutter element comprising:

a disc-like body with opposed planar surfaces and a plurality of cutting teeth extending outwardly from said body, each of the cutting teeth having an outermost edge which defines a maximum diameter of said cutter element, said cutter element having a hub portion defined in at least one of said opposed planar surfaces, the hub portion lying adjacent to an intervening spacer element when said cutter element is assembled into said waste comminutor cutting assembly, said hub portion further defining a minimum diameter of said cutter element, said cutter element further including a plurality of individual depressions corresponding in number to the number of cutting teeth on said body, said depressions being formed in at least one of said opposed planar surfaces between said maximum and minimum diameters and being spaced apart from each other, whereby each individual depression is associated with a single cutting tooth of said cutter element, said depression having at least one sidewall which defines a waste particle comminuting edge in said opposed planar surface at an intersection of said sidewall with said opposed planar surface against which waste may be sheared when a waste particle is caught between said comminuting edge and another cutter element.

12. The cutter element as defined in claim 11, wherein said cutting teeth are spaced apart along a circumferential edge of said body portion.

13. The cutter element as defined in claim 11, wherein said depression has a constant depth and said comminuting edge substantially surrounds said depression.

14. The cutter element as defined in claim 11, wherein said depression has a non-uniform depth.

15. The cutter element as defined in claim 11, wherein said cutter element depressions include a plurality of grooves annularly spaced around said cutter element hub portion, said grooves being separated apart by intervening land portions which define impeller vanes in said cutter element body portion which direct the flow of a waste stream entering said waste comminutor.

16. The cutter element as defined in claim 15, wherein said grooves extend spirally out from said cutter element hub portion.

17. The cutter element as defined in claim 11, wherein said cutting teeth extend outwardly from said cutter element along a root diameter of said cutter element, and said depressions being annularly disposed in said body portion around said hub portion such that each of said depressions intersects said root diameter.

18. The cutter element as defined in claim 11, wherein said depressions are disposed on said cutter element opposed planar surface in a generally circular pattern.

19. An improved cutter element for use in a waste comminutor of the type which is interposed in a wastewater stream for comminuting waste entrained in the wastewater stream, the comminutor having two rotatable shafts supporting two cutting assemblies thereon, each of the cutting assemblies including a plurality of axially alternating cutter elements and spacer elements held together on respective drive shafts, whereby each cutter element is axially spaced-apart from an adjacent cutter element by an intervening spacer element, the spacer elements defining annular interspaces between adjacent cutter elements, said cutter elements and spacer elements of each of said cutting assemblies being held tightly together on said drive shafts by retaining means such that adjacent cutter elements and spacer elements abut each other, said two cutting assemblies of the comminutor being intermeshed such that said cutter elements of one of said two cutting assembles partially project into said annular interspaces of said other of said two cutting assemblies and vice-versa, the projection of said cutter elements into said interspaces defining a cutting zone on opposed planar surfaces of adjacent cutter elements, the cutter element comprising:

a generally circular body portion defined by opposed planar surfaces, an opening disposed in said body portion which receives said cutting assembly shaft, a plurality of cutting teeth extending radially outwardly from said body portion, and at least one recess formed in one of said body portion opposed planar surfaces and solely associated with one of said cutting teeth, the recess being solely disposed in said cutting zone thereof and proximate to said one of said cutting teeth, said recess having at least one sidewall forming a partial boundary of said recess, said sidewall intersecting said one opposed planar surface to define a waste cutting surface in said opposed planar surface in said cutting zone thereof.

20. The improved cutter element of claim 19, wherein said recess intersects with a root diameter of said cutter element.

21. A comminutor for interposition into a stream of waste material for comminuting the waste material carried by the waste stream comprising, a housing having an inlet and an outlet disposed on opposite sides of the housing, first and second drive shafts mounted for rotation within said housing between the inlet and outlet thereof, driving means for driving the first and second drive shafts in counter-rotation, each of said first and second drive shafts supporting respective first and second cutting assemblies, said first and second cutting assemblies including a plurality of cutter elements arranged axially on said respective drive shafts in spaced-apart relationship and separated by intervening spacer elements, said cutter elements having a body portion defined between two opposed planar surfaces thereof, the cutter elements having a plurality of cutting members disposed on outer circumferential edges of the cutter element body portions, said cutter elements of said first cutting assembly being held in registration with said spacer elements of said second cutting assembly and said cutter elements of said second cutting assembly being held in registration with said spacer elements of said first cutting assembly such that said cutter and spacer elements of each of said first and second cutting assemblies tightly abut each other and such that said first and second cutting assembly cutter element opposed planar surfaces partially overlap each other when said cutting assemblies are counter-rotated, said cutter elements having individual, separate waste particle-receiving pockets defined in at least one of said opposed planar surfaces within an area where said overlap occurs, said individual pockets further being spaced apart from each other on said one opposed planar surface, whereby each pocket is associated with only one cutting member of said cutter elements.

22. An improved waste comminutor for interposition into a wastewater stream, the comminutor having two counter-rotating stacks of cutting assemblies driven by a drive means, each cutting assembly including a plurality of cutter elements and spacer elements arranged in alternating order, said cutter and spacer elements each having opposed planar surfaces which abut each other, said cutter and spacer elements further having differing diameters such that said spacer elements present annular interspaces on said cutting assemblies, said two cutting assemblies being spaced apart from each other such that a plurality of coplanar pairs of comminuting elements are defined, each of said pairs including a cutter element and a spacer element, whereby, in every pair of comminuting elements a cutter element of one of said two cutting assemblies projects into said annular interspace associated with a spacer element of said other of said two cutting assemblies and vice-versa, each of said cutter elements including opposed planar surfaces, said opposed planar surfaces of respective cutter elements of said two cutting assemblies overlapping, the improvement comprising:

a plurality of individual waste-receiving pockets formed in said cutter element opposed planar surfaces where said respective cutter elements overlap, each of said pockets being spaced apart from each other in a path on at least one of said cutter element opposed planar surfaces, each said pocket including a waste particle contact surface against which waste particles may be sheared by movement of an adjacent cutter element within said interspace and over said pockets.

23. The improved waste comminutor as defined in claim 22, wherein each of said cutter elements includes a plurality of cutting teeth and individual ones of said pockets are aligned with individual cutting teeth.

24. The improved waste comminutor as defined in claim 22, wherein said pockets include a recess substantially surrounded by a sidewall, said contact surface being defined at an intersection of said sidewall and said opposed planar surfaces.

25. The improved waste comminutor as defined in claim 22, wherein said pockets include grooves extending spirally outwardly from a center portion of said cutter elements, said grooves defining a plurality of impeller vanes on said cutter element opposed surfaces which assist in directing the flow of waste through said comminutor during operation thereof.

26. Apparatus for comminuting waste material entrained in a waste stream, comprising:

a housing defining therein a comminution chamber with inlet and outlet ports disposed on opposite sides of said comminutor chamber and adopted for interposition into the waste stream;

a comminutor assembly including cooperating first and second cutting stacks disposed in said comminution chamber and respectively having a plurality of first concentric cutting elements mounted on a first shaft in interposed relationship with a plurality of second cutting elements mounted concentrically on a second shaft, each of said first and second cutting elements having cutting teeth disposed along respective outer peripheries thereof and wherein said first and second cutting elements of said first and second cutting stacks are positioned between and separated in an axial direction by respective first and second spacer elements, whereby a cutting element from one of said first and second cutting stacks and a corresponding spacer element from the other of said first and second cutting stack lie coplanar to each other to thereby form a pair of interactive waste comminuting members, said first and second cutting elements having planar surfaces which extend radially outwardly respective from said first and second shafts and from adjoining spacer elements, said cutting element planar surfaces including a plurality of individual depressions forming waste-receiving pockets, said pockets being spaced apart from each other on said cutting element planar surfaces such that each of said pockets is isolated from other pockets on said planar surfaces, each said pocket being associated with only one of said cutting teeth of said cutting elements;

means securing said cutting stacks in said housing; and means for driving said first and second cutting stacks in counter-rotation.

* * * * *